US005123371A

United States Patent [19]

Giordano et al.

[11] Patent Number: 5,123,371

[45] Date of Patent: Jun. 23, 1992

[54] TRANSPORTATION DEVICE

[76] Inventors: Peggy E. Giordano, 16 Pole Hill Dr., Andover, Mass. 01810; Linda K. Librizzi, 151 Brigham Hill Rd., Essex Junction, Vt. 05452

[21] Appl. No.: 623,344

[22] Filed: Dec. 7, 1990

[51] Int. Cl.[5] ..... B60P 3/10

[52] U.S. Cl. ..... 114/344; 114/364

[58] Field of Search ..... 114/343, 344, 361, 364, 114/288, 283, 292, 56, 290; 280/8, 9, 11

[56] References Cited

U.S. PATENT DOCUMENTS

| | | | |
|---|---|---|---|
| 2,536,152 | 1/1951 | Bass | 114/361 |
| 2,936,465 | 5/1960 | Mayfield | 114/364 |
| 3,203,438 | 8/1965 | Watts et al. | 114/361 |
| 3,227,122 | 1/1966 | Noe | 114/290 |
| 3,926,136 | 12/1975 | Shroyer | 114/123 |
| 4,554,884 | 11/1985 | Bouliane | 114/344 |

FOREIGN PATENT DOCUMENTS

| | | | |
|---|---|---|---|
| 1533365 | 7/1968 | France | 114/364 |

*Primary Examiner*—Jesus D. Sotelo
*Attorney, Agent, or Firm*—Edward A. Gordon

[57] ABSTRACT

A transportation device for the reception and transporting of persons and/or items over hard and soft surfaces including water. The transportation device includes a hull member having a bottom portion and upwardly extending side, forward and rear portions. At least the side portions, and in the preferred embodiment the front and rear portions as well, terminate in horizontally extending rim members which have portions defining holes therein which are used for attaching various articles such as, for example, canopies, covers, umbrellas and fluid containers. Wheel members are provided which can be permanently or releasably attached to the hull member whereby the transportation device can be rolled over a hard surface. The transportation device also includes a plurality of elongated spaced rib members disposed on the outer surface of the bottom portion of the hull member and extending longitudinally between the forward and rear portions of the hull member. The elongated spaced rib members are adapted so that the transportation device can be operated as a sled-like device for sliding movement over soft surfaces such as sand, snow and the like.

22 Claims, 4 Drawing Sheets

TRANSPORTATION DEVICE

BACKGROUND OF THE INVENTION

1. Field Of The Invention

The present invention relates generally to devices used for carrying items for recreational use and more particularly to a transportation device which is particularly adapted for the carrying of individuals and/or items over various surfaces such as hard and soft ground surfaces, snow and ice surfaces and water.

2. Description Of Prior Art

Numerous prior art devices have been provided for carrying items for shopping and recreational use over hard and soft surfaces.

One such device is disclosed in U.S. Pat. No. 4,863,075 in which a beach caddy comprises a basket provided with runners for drawing across sandy surfaces and detachable wheels for rolling over paved surfaces.

U.S. Pat. No. 4,139,208 discloses a cart for moving loads over hard and soft surfaces mounted on two inverted "T" shaped runners with wheels collapsibly mounted between the runners.

U.S. Pat. No. 2,926,021 discloses a beach carryall vehicle adapted to transport supplies over hard paved surfaces as well as beach sand including a pair of side runners, a pair of wheels, a wire mesh base and side member.

The foregoing patents as well as the following U.S. Pats. are believed to exemplify the present state of the art with respect to such transportation devices:

U.S. Pat. No. 4,191,139
U.S. Pat. No. 23,084,947
U.S. Pat. No. 3,927,894
U.S. Pat. No. 3,046,031

While such prior art devices provide improvement in the areas intended, there still exists a need for a transportation device which overcomes the disadvantages of such prior art devices which typically do not provide for moving individuals and/or items over various surfaces such as hard and soft ground surfaces, snow, ice and water surfaces; are awkward to assemble for uses; do not provide for a combination of simplicity, strength and durability in a high degree, together with an economical manufacturing potential.

Accordingly, a principle desirable object of the present invention is to overcome the disadvantages of the prior art.

Another desirable object of the present invention is to provide a transportation device which is adapted for the carrying of items and/or individuals over various types and conditions of terrain and water.

A still further desirable object of the present invention is to provide a transportation device of the foregoing desirable objects which also provides for recreational use on various terrains and upon water.

A still further desirable object of the present invention is to achieve the above desirable objects with an essentially simple structure lending itself to inexpensive mass production.

These and other desirable objects of the present invention will in part appear hereinafter and will in part become apparent after consideration of the specification with reference to the drawings and the claims.

SUMMARY OF THE INVENTION

The present invention provides a new and improved transportation device for the reception and transporting of persons and/or items over hard and soft surfaces including water. The transportation device includes a hull member having a bottom portion and upwardly extending side, forward and rear portions. The hull member is formed of a water impermeable material whereby the transportation device also serves as a water floating device. At least the side portions, and in the preferred embodiment the front and rear portions as well, terminate in a horizontally extending rim edge. The rim edge has portions defining holes therein which are used for attaching various articles such as, for example, canopies, covers, umbrellas and fluid containers. A pair of axial wheel members are provided which can be permanently or releasably attached adjacent the outer surface of each side portion of the hull member whereby the transportation device can be rolled over a hard surface. The transportation device also includes a plurality of elongated spaced rib members disposed on the outer surface of the bottom portion of the hull member and extending longitudinally between the forward and rear portions of the hull member. The elongated spaced rib members are adapted so that the transportation device can be operated as a sled-like device for sliding movement over soft surfaces such as sand, snow and the like. In one embodiment the rib members are formed in two small groups which are positioned in spaced relationship adjacent the outer side surfaces of the bottom portion of the hull member so that each group forms a ski-like structure.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENTS

Figure 1:
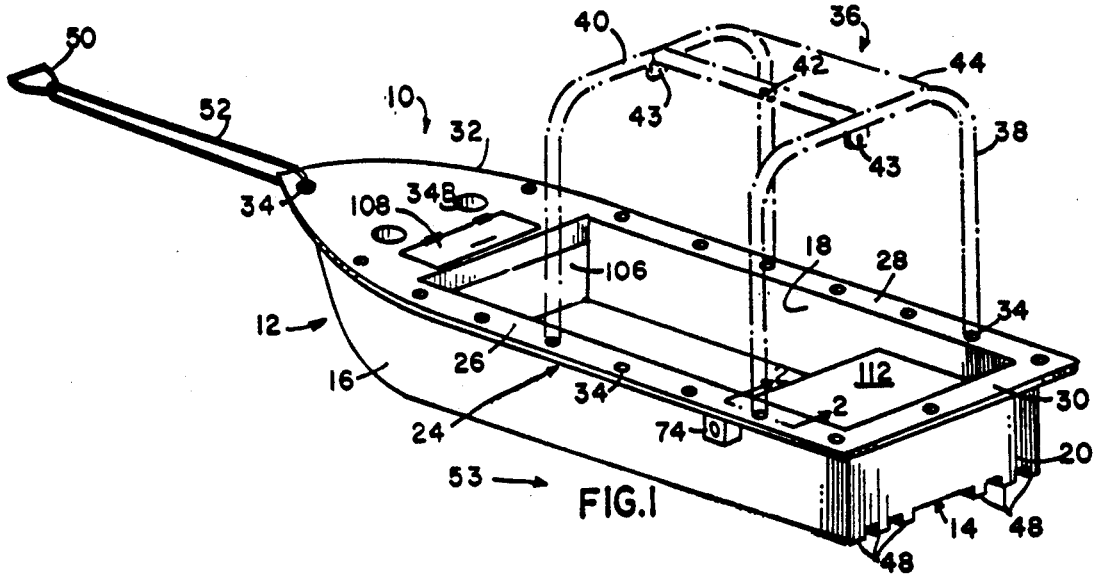
FIG. 1 is a perspective view illustrating one embodiment of a transportation device embodying the principles of the present invention and showing the transportation device in use on a soft surface such as sand, snow, etc.
Figure 3:
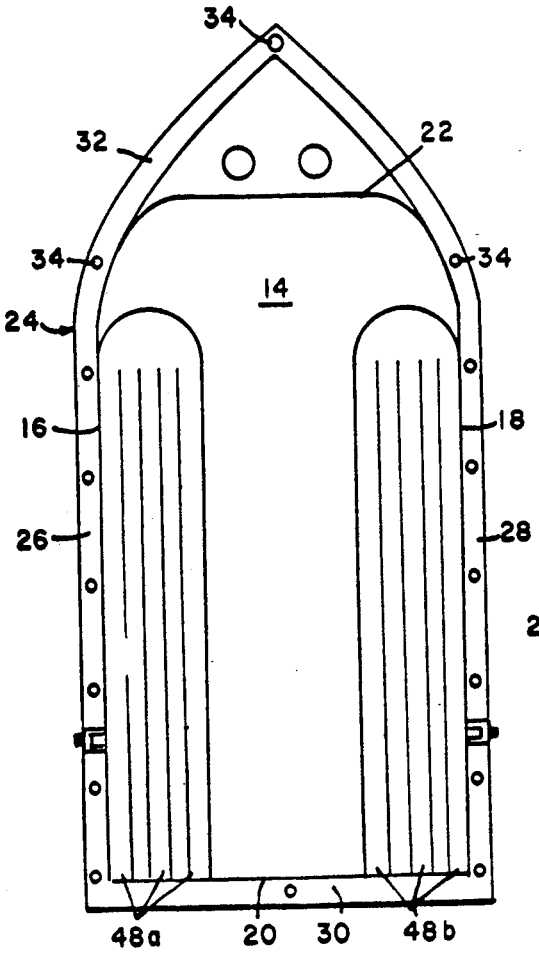
FIG. 3 is a bottom plan view of the transportation device embodiment of FIG. 1.
Figure 2:
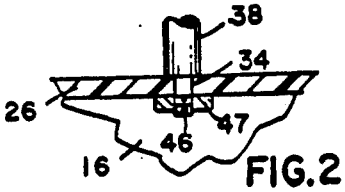
FIG. 2 is a fragmentary cross-sectional view taken along the line 2—2 of FIG. 1.

Referring now to the drawings and more particularly to FIGS. 1-3, there is illustrated an embodiment of the transportation device, indicated generally by the reference numeral 10, embodying the principles of the present invention. As illustrated, the transportation device 10 includes a hull member 12 having a bottom portion 14, upwardly extending side portions 16 and 18, upwardly extending rear portion 20 and upwardly extending front portion 22. In the embodiment as illustrated, the overall configuration of the hull member 12 is boat-like. The upper ends of at least the side portions and preferably as illustrated, the front, rear and side portions terminate in a horizontally extending rim edge, indicated generally by the reference numeral 24, having side edge portions 26 and 28, a rear edge portion 30 and a front edge portion 32. Portions of the rim edge 24 define a plurality of holes 34. The hull member 12 can be formed of a suitable water impermeable material such as plastic, wood, metal or combinations thereof. As illustrated in FIGS. 1 and 2, the transportation device 10 can be provided with a removable canopy 36, illustrated in phantom in FIG. 1. The canopy 36 comprises a frame member formed of two downward C-shaped vertical members 38 and 40 and an upper horizontal member 42 attached to the vertical members 38 and 4 to maintain the vertical members 38 and 40 in spaced relationship to each other. The horizontal member 42 is preferably formed of two sections which are connected in the center and at each opposing end by pivotal means such as conventional bolt and nut means 43 which when loosened permits the frame members 38 and 40 to be pivotally brought together so as to fold the frame when not in use. The frame members 38, 40 and 42 are preferably formed of a lightweight material such as plastic, wood or metal and are covered with a flexible material 44 which is preferably formed of a commercial heat reflective and fluid impermeable material such as, for example, metal coated polyester. The vertical frame members are formed having a cross-section at least adjacent the ends, as illustrated by frame member 38 in FIG. 2, greater than the diameter of the 15 holes 34 with a lower section 46 having a cross-sectional area smaller than the hole 34 so that it can be supported by inserting into the holes 34 of the rim edge 24 such as the side section 26 as illustrated in FIG. 2. In this manner the canopy 36 can be easily and quickly installed and removed. Also, the lower section 46 can be releasably attached by conventional threaded bolt means 47. When desired, the canopy serves to protect the individual and/or items contained within the transportation device 10 from sun, rain, etc..

A plurality of elongated spaced rib members 48 are disposed on the outer surface of the bottom portion 14 of the hull member 12 and extend between the rear and front portions 20 and 22 of the hull member 12 whereby the transportation device can be operated as a sled-like device for sliding movement over soft surfaces such as sand, snow and the like. In the embodiment illustrated in FIGS. 1 and 3, the rib members are formed in two groups 48a and 48b as best seen in FIG. 3 to form ski or sled-like surfaces.

As illustrated in FIG. 1, the transportation device 10 is provided with a handle 50 which is attached to the front of the rim edge portion 32 by a flexible cord 52 which is inserted through the handle 50 and the hole 34 defined by the front rim edge portion 32 and thereby provides means for pulling the transportation device 10 over hard surfaces as described hereinafter or soft surfaces 53 as illustrated.

Figure 4:
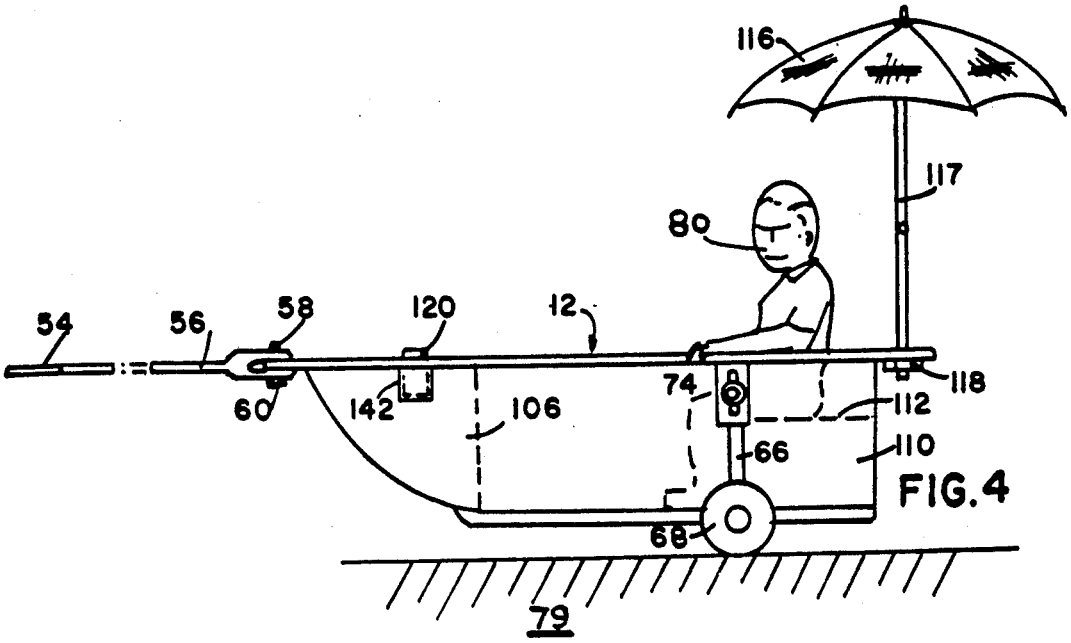
FIG. 4 is a side plan view of the transportation device of FIG. 1 showing the wheel assembly in operating position on a hard surface with a person being transported.
Figure 5:
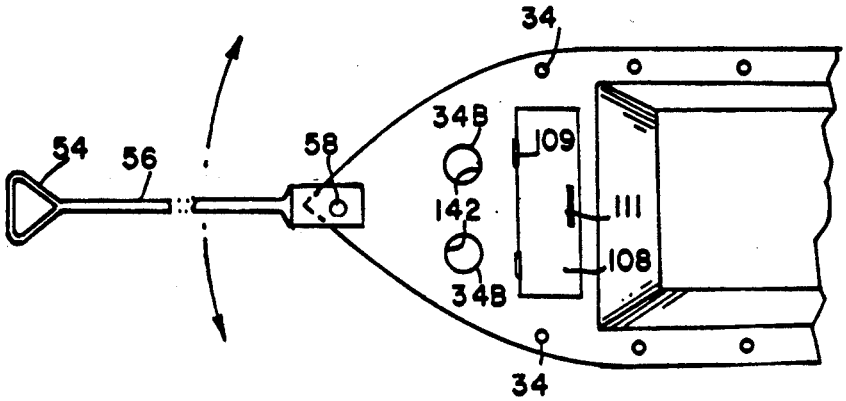
FIG. 5 is a fragmentary top plan of the pulling member of FIG. 4.

Referring now to FIGS. 4 and 5, an alternate embodiment of the handle assembly is illustrated. As shown the handle member 54 is attached to a rigid arm member 56 which is attached by conventional bolt and nut members 58 and 60 respectively through the forward hole 34 of the rim edge portion 32. The conventional bolt attachment is adapted to permit the handle and arm member to be moved laterally as shown by the arrows of FIG. 5.

Figure 7:
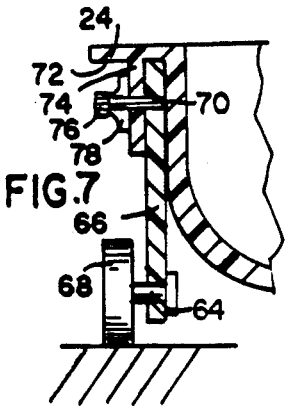
FIG. 7 is a fragmentary cross-sectional view of the wheel assembly in attached operating position on one side of the transportation device.
Figure 6:
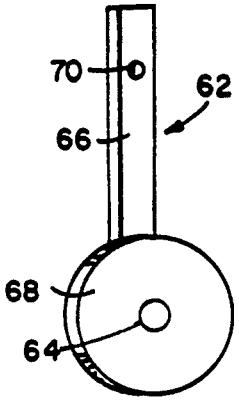
FIG. 6 is a perspective view of an axial wheel assembly.

Referring now to FIGS. 4, 6 and 7, there is shown an axial wheel assembly 62 including an axle 64 attached to leg member 66 with a rotatable wheel 68. The upper portion of the leg member defines a hole 70. Attached to each side of the hull member 12 adjacent to the lower surface 72 of the rim edge 24 is a sleeve member 74 for releasably attaching the axial wheel assemblies 62 to each side of the hull member 12. The releasable attachment of the axial wheel assembly is provided by bolt member 76 and attached resilient spring member 78 which permits the bolt member 76 to be inserted into hole 70 of the arm member 66 of the wheel assembly. The wheel assembly members 62 provide for the transportation device to be rolled over a hard surface 79 when transporting an individual 80, for example, as shown in FIG. 4. It is to be understood that the present invention contemplates an embodiment where additional wheel assemblies may be included to provide a total of four, for example.

Figure 9:
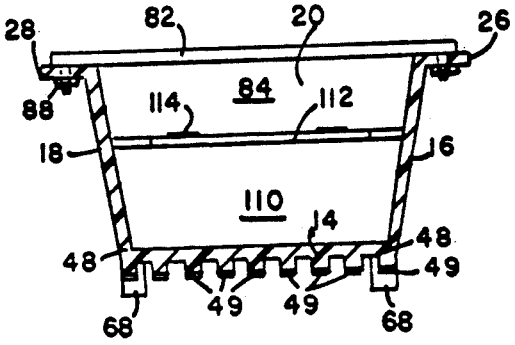
FIG. 9 is a cross-sectional view taken along the line 9—9 of FIG. 8.
Figure 8:
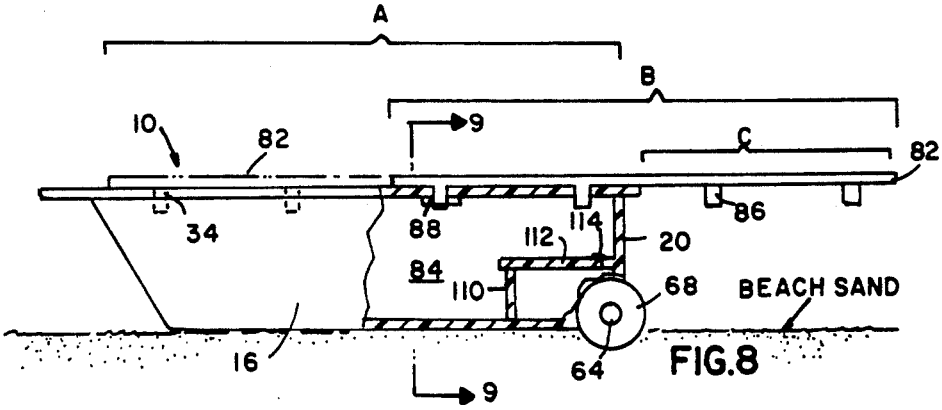
FIG. 8 is a side plan view partially in cross-section illustrating an alternate embodiment of a transportation device in accordance with the present invention.

Referring now more particularly to FIGS. 8 and 9, there is illustrated an alternate embodiment of the transportation device 10 which includes a rigid cover member 82 which serves to cover the interior space 84 of the hull member 12 defined by the bottom, side, rear and front portions 14-22 of the hull member 12 as illustrated in FIGS. 1-3. In this manner items contained within the space 84 can be protected from various conditions and for various purposes. The cover member 82 is provided with peg members 86 which are threaded to receive nuts and are spaced to mate with the holes 34 in the rim edge 24. When the transportation device 10 is used at a beach, for example, the cover member 82 can be moved from the position A to the position B whereby the portion C extending beyond the rear portion 20 of the transportation device 10 can serve as a support member for various conventional uses such as a table, for example. In such a use, the inner end of the cover 82 can be provided with threaded pegs as mentioned to which a nut 88 can be attached to both sides to hold the cover 82 in the support position. Additionally, as shown in this embodiment, the wheel members 68 are attached to the rear portions of the side hull members 16 and 18 by axial member 64.

It is to be understood that other types of cover members can be used such as, for example, flexible fabrics and elastic nettings in place of or in addition to the rigid cover 82.

Also as illustrated in FIG. 9, the bottom portion 14 of the hull member 12 is provided with a plurality of spaced rib members 48 which extend across the bottom portion 14 and which in this embodiment are not formed in groups as discussed with respect to FIG. 3. Also as illustrated, in an alternate embodiment, the rib members 48 can be provided with an outer metal strip 49 which reduces the wear of the rib members 48 when formed of wood or plastic, for example. In all other respects the transportation device shown in FIGS. 8 and 9 is the same as 10 of FIG. 1.

Figure 10:
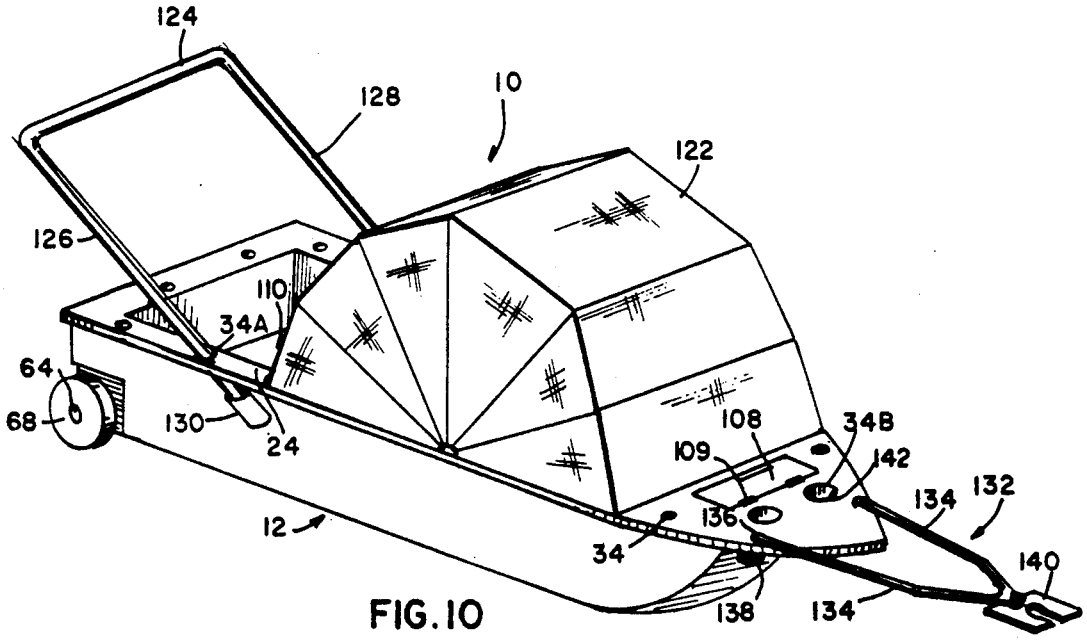
FIG. 10 is a perspective view of the transportation device of FIG. 8 illustrating a retractable canopy, a bike adaptor, and a rear push bar.

Referring now to FIG. 10, there is illustrated an alternate embodiment of a transportation device 10 in accordance with the present invention. As illustrated, the transportation device 10 includes a retractable canopy 122 which can be attached to the rim edge 24 and the holes 34 defined thereby in the same manner as the canopy 36 of FIG. 1.

Also as shown, the transportation device 10 is provided with a removable push handle 124 which can be attached by inserting the end portions of the side members 126 and 128 through a pair of apertures 34A which can be formed at an angle to the horizontal rim edge or enlarged so that the end member can be inserted through lateral respective holes 34 and into respective sleeve members 130. In this manner, when the transportation device is being pulled by the flexible or rigid handle assemblies as shown in FIGS. 1 and 5, the movement of the transportation device can be assisted by one or more persons pushing the handle member 124.

When the transportation device is to be pulled on a hard surface by a bike, for example, a handle, illustrated generally by the numeral 132, is contemplated by the present invention. As shown, the handle 132 comprises a pair of rod members 134 having end portions 136 angularly bent and threaded (not shown) so as to be inserted into a hole 34 in the rim edge and releasably attached by nut members 138. The rod members 134 taper forwardly and are integrally joined to member 140 which constitutes a conventional bike adaptor clamp grip for attachment to a conventional vertical seat frame (not shown), for example, of a bike.

Additionally, it can be appreciated that when the rigid rod members 134 are employed, as well as the rigid arm member 56 and handle 54 described in FIGS. 4 and 5, the hull member 12 in FIG. 10 in particular can be moved upwardly and downwardly to bring the wheel members into and out of operative contact with hard surfaces. In the embodiment shown in FIG. 10 the wheel members are essentially out of contact with the surface when the transportation device is in a downward position which is particularly suitable for soft surfaces such as beach sand.

Figure 11:
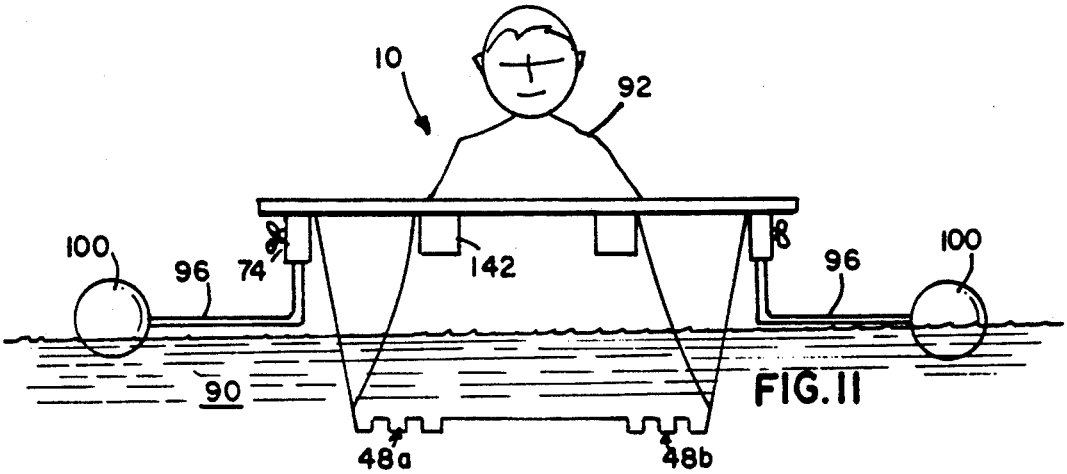
FIG. 11 is a front plan view illustrating the transportation device of FIG. 1 in floating operation position in water with a person on board and further including float leveling members.
Figure 12:
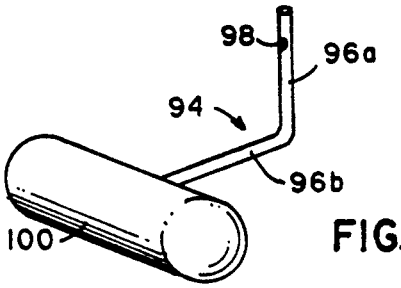
FIG. 12 is a perspective view of a float leveling member.

Referring now to FIGS. 11 and 12, there is illustrated the transportation device 10 of FIG. 1 in floating operation position in water 90 with a person 92 on board. Where the person 92 is a child, for example, the transportation device further includes float leveling members 94 which include right angle arm members 96 having a vertical portion 96a defining a hole 98 for attachment to the sleeve member 74 in the same manner as the wheel assembly 62 and, a horizontal portion 96*b* to which is attached a hollow air tight float member 100. In this manner the transportation device 10 is prevented from tipping over in the water.

Figure 13:
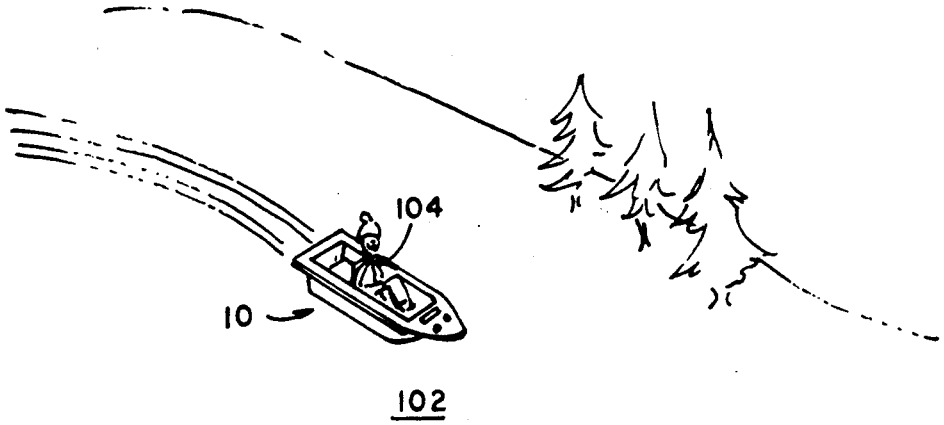
FIG. 13 is a perspective view illustrating the transportation device in use sliding down a snow covered hill with a person on board.

Referring now to FIG. 13 of the drawing, there is illustrated the transportation device 10, as described with respect to FIG. 1, in use sliding down a snow covered hill 102 with a person 104 on board.

In the embodiments of the transportation device as illustrated in FIGS. 1, 4, 8, 9 and 10, the hull member 12 is preferably provided with a forward compartment 106 provided with a top door member 108 (as best seen in FIGS. 1 and 5) which is provided with suitable hinge members 109 and handle member 111, and a bench type compartment 110 (as best seen in FIG. 8) with an upper cover member 112 attached to the rear portion of the hull member by hinge members 114. The forward compartment 106 and bench compartment 110 are illustrated in phantom in FIG. 4.

Additionally, the transportation device also includes an umbrella member 116 (as shown in FIG. 4) having a pole member 117 which is attached to the rim edge 24 through a selected hole 34 by threaded engagement with nut member 118. It is to be understood that additional umbrellas can be attached to other selected areas of the rim member 24.

In view of the foregoing description, it can be appreciated that the transportation device of the present invention provides a unique transportation device which is not only particularly suitable for various recreational purposes but also includes transportation for individuals including children and handicapped persons and also various items.

Additionally as illustrated in FIGS. 1, 4, 5 and 10, the holes 34B defined by a portion of the rim edge 24 can be varied in size and provided with a lower container section 142 to receive and hold fluid containers such as drinking glasses 120 illustrated in phantom in FIG. 4.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A transportation device for the reception and transporting of persons and/or items over hard and soft surfaces including water, said transportation device comprising:

hull member having a bottom portion and upwardly extending forward, rear and left and right side portions;

said hull member being formed of a water impermeable material whereby said transportation device serves as a water floating device;

said side, forward and rear portions terminating upwardly in a horizontally outwardly extending rim edge;

said rim edge having portions defining a plurality of holes therein;

said holes adapted to receive and support selected structures therein;

a handle member attached to the forward rim edge by a flexible cord member for pulling the transportation device along hard and soft surfaces;

a pair of axially rotatable wheel members respectively mounted on said side portions adjacent said rear portion for rolling supporting engagement with a hard surface; and a plurality of elongated spaced rib members disposed on the outer surface of the bottom portion of said hull member and extending between the forward and rear portions of said hull member whereby said transportation device provides for sliding movement over soft surfaces such as sand and snow.

2. The transportation device according to claim 1 wherein the supported structure is the pole of an umbrella.

3. The transportation device according to claim 1 wherein the supported structure is a canopy.

4. The transportation device according to claim 1 wherein the supported structure is a retractable canopy.

5. The transportation device according to claim 1 wherein the supported structure is a fluid container.

6. The transportation device according to claim 1 wherein the supported structure is a rear push handle means.

7. The transportation device according to claim 1 wherein the supported structure is attachment means for attaching the transportation device to a bike.

8. The transportation device according to claim 1 wherein the supported structure comprises a cover means disposed across the hull member.

9. The transportation device according to claim 1 further including at least one compartment disposed within the hull member.

10. A transportation device for the reception and transporting of persons and/or items over hard and soft surfaces including water, said transportation device comprising:

a hull member having a bottom portion and upwardly extending forward, rear and left and right side portions;

said hull member being formed of a water impermeable material whereby said transportation device serves as a water floating device;

said side, forward and rear portions terminating upwardly in a horizontally outwardly extending rim edge;

said rim edge having portions defining a plurality of holes therein;

said holes adapted to receive and support selected structures therein;

a pair of axially rotatable wheel members respectively mounted on said side portions adjacent said rear portion for rolling supporting engagement with a hard surface;

a handle member attached to the forward rim edge by a rigid arm member for pulling the transportation device along hard and soft surfaces;

said rigid arm member being laterally pivotal and vertically non-pivotal whereby the forward portion of the transportation device may be moved upwardly and downwardly to being the wheel members into and out of operative contact with hard surfaces; and a plurality of elongated spaced rib members disposed on the outer surface of the bottom portion of said hull member and extending between the forward and rear portions of said hull member whereby said transportation device provides for sliding movement over soft surfaces such as sand and snow.

11. A transportation device for the reception and transporting of persons and/or items over hard and soft surfaces including water, said transportation device comprising:

a hull member having a bottom portion and upwardly extending forward, rear and left and right side portions;

said bottom portion forming a horizontal plane;

said hull member being formed of a water impermeable material whereby said transportation device serves as a water floating device;

said side, forward and rear portions terminating upwardly in a horizontally outwardly extending rim edge;

said rim edge having portions defining a plurality of holes therein;

said holes adapted to receive and support selected structures therein;

a first group of elongated spaced rib members disposed on the left side of the outer bottom portion of the hull member and extending between the forward and rear portions of the hull member;

a second group of elongated spaced rib members disposed on the right side of the outer surface of the bottom portion of the hull member and extending between the forward and rear portion of the hull member;

said rib members each having downwardly extending parallel side surfaces and a flat horizontal bottom surface; said bottom surface having a metal strip member attached thereto whereby said transportation device provides for sliding movement over soft surfaces such as sand and snow;

a pair of axially rotatable wheel members respectively mounted on said side portions adjacent the rear portion for rolling supporting engagement with a hard surface; and a handle means attached to the forward rim member for pulling the transportation device.

12. A transportation device for the reception and transporting of persons and items over hard and soft surfaces including water, said transportation device comprising:

a hull member having a bottom portion and upwardly extending front, rear and side portions;

said hull member being formed of a water impermeable material whereby said transportation device alternately serves as a water floating device;

at least said side portions of the bottom portion of said hull member terminating upwardly in horizontally outwardly extending rim members;

said rim members having portions defining holes therein; and a plurality of elongated spaced rib members disposed on the outer surface of the bottom portion of said hull member and extending between the front and rear portions of said hull member;

the outer surface of the elongated spaced rib members having a metallic layer thereon whereby said transportation device provides for sliding movement over soft surfaces such as sand, snow and hard surfaces such as ice.

13. The transportation device according to claim 12 further including:

a pair of axially rotatable wheel members; and means for releasably attaching each of said wheel members adjacent the outer surface of each side portion of said hull member whereby said transportation device can be rolled over a hard surface.

14. The transportation device according to claim 12 further including pulling means for pulling the transportation device.

15. The transportation device according to claim 12 wherein the rim edge and a selected hole defined therein supports the pole of a beach umbrella.

16. The transportation device according to claim 12 further including a compartment formed in the front portion of the hull member, said compartment including an access door means.

17. The transportation device according to claim 12 further including a bench compartment formed in the rear portion of the hull member, said compartment including an access door means.

18. The transportation device according to claim 12 further including a pair of float members; and means for attaching said float member adjacent the outer surface of each side portion of said hull member whereby said transportation device can be maintained in upright position when serving as a water transportation device.

19. The transportation device according to claim 12 further including a retractable canopy releasably attached to said hull member.

20. The transportation device according to claim 12 wherein said rib members are disposed in two groups positioned in lateral relationship to each other adjacent the outer side edges of the bottom portion of said hull member.

21. The transportation device according to claim 12 further including a rigid cover member mountable on the rim member of the hull member; said cover member including means for releasably attaching said cover member at selected positions on the hull member.

22. The transportation device according to claim 12 further including a detachable flexible cover member mountable on the rim member.

* * * * *